US012252863B2

(12) United States Patent
Rodriguez et al.

(10) Patent No.: US 12,252,863 B2
(45) Date of Patent: Mar. 18, 2025

(54) ANCHORING KIT FOR A DRILLING MACHINE

(71) Applicant: SOLETANCHE FREYSSINET, Rueil Malmaison (FR)

(72) Inventors: Pascal Rodriguez, Rueil Malmaison (FR); Daniel Viargues, Rueil Malmaison (FR)

( * ) Notice: Subject to any disclaimer, the term of this patent is extended or adjusted under 35 U.S.C. 154(b) by 982 days.

(21) Appl. No.: 17/259,567

(22) PCT Filed: Jul. 10, 2019

(86) PCT No.: PCT/FR2019/051734
§ 371 (c)(1),
(2) Date: Jan. 12, 2021

(87) PCT Pub. No.: WO2020/012124
PCT Pub. Date: Jan. 16, 2020

(65) Prior Publication Data

US 2021/0270000 A1 Sep. 2, 2021

(30) Foreign Application Priority Data

Jul. 13, 2018 (FR) ..... 18 56478

(51) Int. Cl.
*E02F 3/20* (2006.01)
*E02D 17/13* (2006.01)
(Continued)

(52) U.S. Cl.
CPC ..... *E02F 3/205* (2013.01); *E02D 17/13* (2013.01); *E02F 3/475* (2013.01); *E02F 5/08* (2013.01)

(58) Field of Classification Search
CPC ... E21B 4/18; E21B 3/00; E21B 10/08; E02D 17/13; E02D 2600/30; E02F 3/205;
(Continued)

(56) References Cited

U.S. PATENT DOCUMENTS 3,894,587 A * 7/1975 Sourice ..... E02D 17/13 175/96
6,839,988 B2 * 1/2005 Gessay ..... E02F 3/22 299/59
(Continued)

FOREIGN PATENT DOCUMENTS

DE 1534611 A1 8/1969
DE 3615068 C1 10/1987
(Continued)

OTHER PUBLICATIONS

English language abstract of EP0811724.
(Continued)

*Primary Examiner* — Adam J Behrens
*Assistant Examiner* — Blake E Scoville
(74) *Attorney, Agent, or Firm* — Cabinet Beau De Lomenie; Jonathan Bingham; Brian Gordaychik

(57) ABSTRACT

The invention relates to an anchoring kit for a drilling machine provided with a frame, the anchoring kit including at least a first anchoring module having: a first part including an anchoring device for immobilizing the first part in the soil; a second part including a device for fixing to the frame; and a displacement device for moving the second part relative to the first part along a first direction.

15 Claims, 4 Drawing Sheets

(51) Int. Cl.
*E02F 3/47* (2006.01)
*E02F 5/08* (2006.01)

(58) Field of Classification Search
CPC ..... E02F 3/46; E02F 3/20; E02F 3/475; E02F 9/085; E02F 5/08
See application file for complete search history.

(56) References Cited

U.S. PATENT DOCUMENTS

| | | | | |
|---|---|---|---|---|
| 6,839,989 | B2 * | 1/2005 | Gessay | E02F 3/205 299/81.3 |
| 7,637,038 | B2 * | 12/2009 | Arzberger | E02D 17/13 37/189 |
| 8,640,364 | B2 * | 2/2014 | Arzberger | E02D 17/13 37/189 |
| 10,006,285 | B2 | 6/2018 | Kuramoto | |
| 10,480,147 | B2 * | 11/2019 | Cascarino | E02D 17/13 |
| 10,697,147 | B2 | 6/2020 | Cascarino et al. | |
| 10,724,200 | B2 | 7/2020 | Cascarino et al. | |

FOREIGN PATENT DOCUMENTS

| | | | | |
|---|---|---|---|---|
| EP | 0592329 | A1 * | 4/1994 | |
| EP | 0811724 | A1 * | 12/1997 | |
| WO | 2017/042499 | A2 | 3/2017 | |
| WO | WO-2017042500 | A1 * | 3/2017 | E02D 17/02 |

OTHER PUBLICATIONS

English language abstract of EP0592329.
English language abstract of DE3615068.
Machine translation of DE1534611.

* cited by examiner

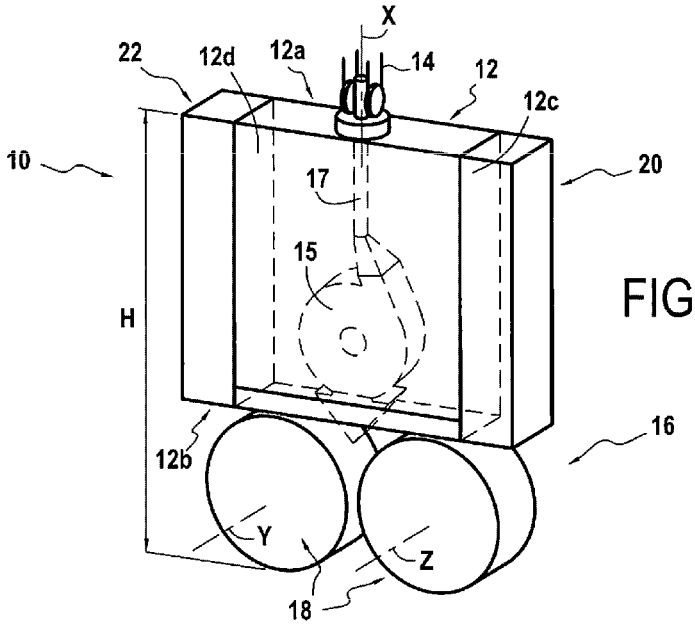
FIG.1
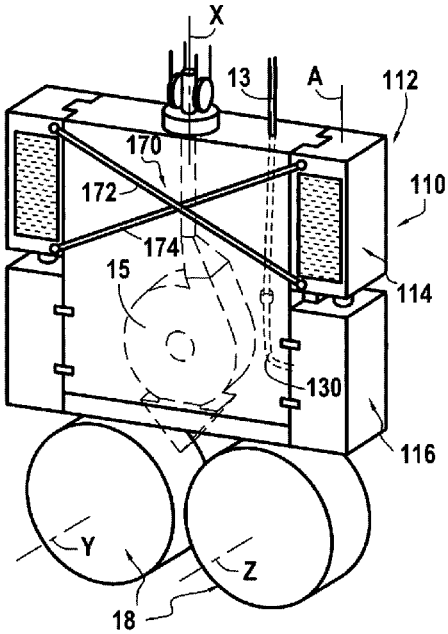
FIG.2
FIG.3
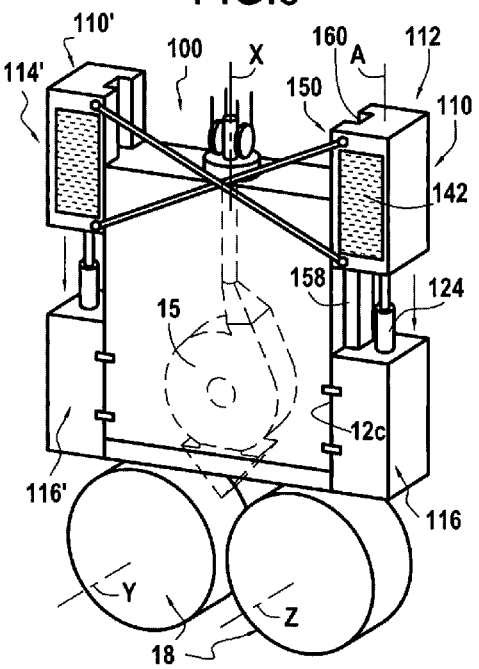

ANCHORING KIT FOR A DRILLING MACHINE

BACKGROUND OF THE INVENTION

The present invention relates to the field of drilling in the soil, in particular with a view to manufacturing foundations, such as for example continuous screens consisting of juxtaposed concrete wall elements.

It concerns more specifically the field of drilling machines for performing excavations in the soil along a substantially vertical drilling direction.

In order to perform such an excavation, it is known to use a drilling machine comprising a frame carrying a drilling module. The frame is generally suspended from a cable that extends from the end of the mast of a tracked carrier. The drilling module includes cutting members, most often cutting drums that are rotatably mounted about axes of rotation perpendicular to the drilling path. Such a machine is generally called a milling cutter.

Most of the drilling machine models available on the market are not suitable for drilling hard or very hard soils. This type of standard machine allows forming in the soils such as clay, sand or soft rocks, but generally not in inhomogeneous soils including hard rock or limestone.

In order to drill such types of soils, it is known to use machines provided with anchoring modules, as described in document EP 0 811 724 or WO2017042499. However, these machines are very specific and more expensive than standard machines. In addition, it is sometimes difficult for an operator to have on the same construction site a standard machine and a specific machine for hard soils, for both cost and logistical reasons.

OBJECT AND SUMMARY OF THE INVENTION

An aim of the present invention is to overcome the aforementioned drawbacks by proposing an anchoring kit that can be mounted on an existing standard drilling machine.

To do so, the invention relates to an anchoring kit for a drilling machine provided with a frame carrying a drilling module, the anchoring kit including at least a first anchoring module which comprises:

- a first part including an anchoring device for immobilizing the first part in the soil;
- a second part including a fixing device for fixing the second part to the frame, the second part cooperating with the first part;
- a displacement device for moving the second part relative to the first part along a first direction.

The anchoring kit according to the invention is preferably intended for a standard drilling machine for making vertical trenches in the soil.

The frame of the drilling machine extends along a longitudinal direction, which is generally vertical.

It is understood that the anchoring kit according to the invention is provided to be mounted on an existing standard machine without an anchoring module. By "anchoring module" is meant a module for immobilizing a part of the drilling machine in the soil, by bearing on the walls of the trench.

The anchoring kit therefore constitutes a structural unit distinct from the drilling machine which is added onto an existing and operational drilling machine. The anchoring kit is mounted to the drilling machine through the fastening device that fixes the second part to the frame.

The anchoring device is advantageously configured to immobilize the first part in the soil.

It is also understood that the fixing device allows fixing the second part to the frame of the standard drilling machine. The fixing device is advantageously dismountable in order to be able to dismount the anchoring kit when the latter is no longer useful.

When the anchoring device is actuated, the first part is immobilized in the soil. It is in particular blocked along the vertical direction. Then, when the displacement device is actuated, the second part is moved relative to the first part which remains fixed. The displacement device therefore applies a force on the second part, which force is transmitted to the frame and to the drilling module. The fact that the first part is immobilized in the soil allows applying a significant force to the drilling module, which facilitates the drilling of hard grounds.

Preferably, the displacement of the second part relative to the first part is a translation.

The second part preferably includes a guide pad to facilitate the vertical sliding of the second part along a wall of the trench.

In order to allow the relative displacement of the first part relative to the second part, the displacement device advantageously includes an actuator connected to the first part and to the second part of the first anchoring module. The actuator is advantageously disposed between the first part and the second part of the first anchoring module.

According to the embodiment envisaged, this actuator can exert a push or a pull on the second part.

Without departing from the scope of the present invention, it is possible to provide several actuators between the first and the second part.

Preferably, the anchoring kit is supplied with energy by the drilling machine.

Preferably, the actuator comprises a hydraulic cylinder, and the anchoring kit further includes a hydraulic fitting connected to the hydraulic cylinder, the hydraulic fitting being configured to be connected to a hydraulic hose of the frame.

The presence of the hydraulic fitting allows easy mounting of the anchoring kit to the standard drilling machine and quick implementation of the anchoring kit to the drilling machine.

Advantageously, the anchoring device includes a first and a second anchoring pad which are deployable along a second direction transverse to the first direction, the direction of deployment of the first pad being opposite to the direction of deployment of the second pad.

When the drilling machine equipped with the anchoring kit is disposed in the trench and when the anchoring device is actuated, the first and second anchoring pads are deployed and bear against the opposite walls of the trench, preferably the two largest walls, which immobilizes the first part in the trench.

Without departing from the scope of the present invention, the first and second anchoring pads can alternately be deployed so as to bear against the two smallest walls of the trench.

Preferably, the first part further includes a body, and the anchoring device includes an actuator connected to the first and second pads, the actuator being slidably mounted relative to the body along a third direction transverse to the first direction.

Thanks to this mounting called "floating" mounting, the anchoring of the anchoring device in the trench does not cause the displacement of the body along the third direction.

One advantage is to avoid moving the frame during the anchoring in the trench, which allows not deflecting the drilling path.

Advantageously, the first anchoring module further includes a guide system for guiding the displacement of the frame relative to the first part. This guidance is advantageously carried out along the first direction. Preferably, the guide system has the function of guiding the displacement of the frame in vertical translation relative to the first part. One advantage is to avoid a deflection of the drilling module when the displacement device exerts a vertical force directed downwardly on the drilling module.

Preferably, the guide system includes a first portion and a second portion slidably mounted relative to the first portion along the first direction, in which the second portion includes members for fixing to the frame, while the first portion is fixed to the anchoring device.

According to one advantageous embodiment, the anchoring kit further includes a second anchoring module and, preferably, a connecting device for securing together the first and second anchoring modules.

Preferably, the connecting device is fixed to the first parts of the first and second anchoring modules.

Preferably, the first and second anchoring modules are fixed to each of the small faces of the frame of the drilling machine and the connecting device extends between the first and second anchoring modules. Even more preferably, the connecting device includes first and second connecting members which flank the large faces of the frame.

According to another embodiment, the connecting device includes a passage for guiding the displacement of the frame, in which the displacement device includes a first actuator disposed between the connecting device and the second part of the first anchoring module and a second actuator disposed between the connecting device and the second part of the second anchoring module.

In this embodiment, the connecting device consists of the first parts of the first and second anchoring modules.

The passage is therefore arranged in said first parts. In this configuration, the connecting device has a cross-section, with reference to the longitudinal (vertical) direction of the frame, which is larger than the cross-section of the frame.

The invention further relates to a drilling machine which includes a frame extending along a longitudinal direction and having a lower part carrying a drilling module, said drilling machine further including an anchoring kit according to the invention, the second part of the first anchoring module being fixed to the frame.

Preferably, the anchoring kit further includes a second anchoring module which comprises a second part fixed to the frame.

Advantageously, the lower part of the frame is provided with a pump, said drilling module being provided with cutting drums rotating about axes perpendicular to the longitudinal direction, in which the length of the drilling machine is less than 7 meters.

Such a machine is generally called "milling cutter". More particularly, this drilling machine is a compact milling cutter as its length is less than 7 meters.

Preferably, the length of the kit is substantially equal to the length of the frame.

According to a preferred but not exclusive embodiment, the second part is disposed between the first part and the drilling module. It is therefore understood that the displacement device exerts a vertical push directed downwardly on the first part, and therefore on the frame.

Without departing from the scope of the present invention, it could be provided that the first part to be disposed between the second part and the drilling module. In this case, the displacement device exerts a pull on the frame directed downwardly.

The invention also relates to a method for modifying a drilling machine, in which there is provided a drilling machine with a frame extending along a longitudinal direction, the frame having a lower part carrying a drilling module, method in which:

an anchoring kit according to the invention is provided;

the second part of the first anchoring module of the anchoring kit is fixed to the frame so that the first direction is parallel to the longitudinal direction.

When the anchoring kit includes a second anchoring module, the modification method according to the invention includes fixing the second part of the second anchoring module to the frame, on the face opposite to the one receiving the second part of the first anchoring module.

Preferably, after having mounted the first and second anchoring modules, the aforementioned connecting device is put in place in order to connect together the first and second anchoring modules.

When the drilling machine includes one or more guide module(s) disposed along the small faces of the frame, the modification method includes a step of previously dismounting said guide module(s) before fixing the second part(s) to the small faces of the frame.

BRIEF DESCRIPTION OF THE DRAWINGS

The invention will be better understood upon reading the following description of embodiments of the invention given by way of non-limiting examples, with reference to the appended drawings, wherein:

FIG. 1 is a drilling machine of the compact milling cutter type, known besides;

FIG. 2 illustrates the drilling machine of FIG. 1 equipped with an anchoring kit according to a first embodiment of the invention, the displacement device being retracted;

FIG. 3 illustrates the machine of FIG. 2, the displacement device being deployed to exert on the drilling module a force directed downwardly;

DETAILED DESCRIPTION OF THE INVENTION

Figure 5:
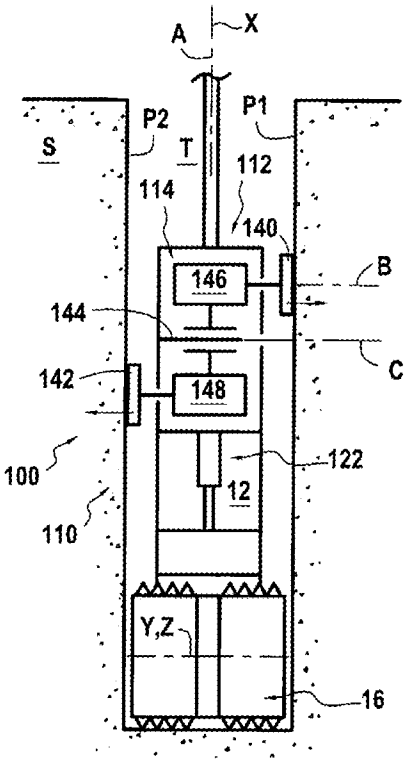
FIG. 5 is a schematic illustration, in side view, of the machine of FIG. 3.

FIG. 1 schematically illustrates a drilling machine 10 which is used to perform an excavation in a soil S. This drilling machine 10, known besides, is a compact milling cutter having a height H on the order of 5 m.

The drilling machine 10 includes a frame 12 having an upper end portion 12*a* which is fixed to lift cables 14. In known manner, the lift cables 14 are connected to the upper end of a mast of a carrier, for example a tracked carrier (not illustrated here).

The frame 12 has a lower end portion 12*b* which carries a drilling module 16. In a known manner, the drilling module 16 includes cutting drums 18 which are rotatable about axes of rotation Y, Z perpendicular to the longitudinal axis X of the frame 12. In this example, the longitudinal axis X of the frame is vertical, while the axes of rotation Y, Z of the rotary drums are horizontal.

The drilling machine 10 further includes a suction member 15 connected to a duct 17 for sucking and removing the cuttings mixed with the drilling mud.

In order to facilitate the sliding of the drilling machine 10 along the walls of the trench, the frame 12 is equipped with a first guide element 20 and a second guide element 22 which are fixed to the smallest faces 12*c*, 12*d* of the frame 12. In a known manner, the guide elements 20, 22 include guide plates allowing the frame to slide along the walls.

Such a drilling machine 10 includes, in a known manner, the drawback of applying a load on the tool, which is too low for drilling hard grounds or on re-bitten panels.

In order to overcome this drawback, the drilling machine 10 of FIG. 1 is modified according to a modification method in accordance with the invention to mount an anchoring kit therein in accordance with the present invention.

It is therefore understood that the anchoring kit 100 constitutes an added structural unit which is distinct from the drilling machine 10.

Three embodiments of the anchoring kit according to the present invention will be described below, as well as the modification method according to the present invention.

Figure 4:
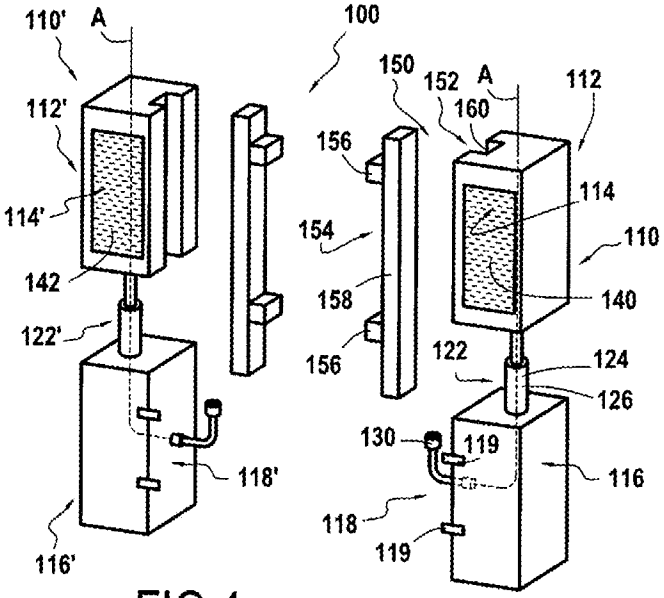
FIG. 4 is a detailed view of the anchoring kit according to the first embodiment.

In FIG. 4, an anchoring kit 100 according to a first embodiment of the invention is illustrated.

The anchoring kit 100 includes a first anchoring module 110 which comprises a first part 112 including an anchoring device 114 for immobilizing the first part in the soil.

The anchoring device 114 will be described in more detail below.

The first anchoring module 114 further includes a second part 116 which includes a fixing device 118 for fixing the second part 116 to the frame 12. In this example, the fixing device 118 includes for example bolts 119.

It can also be observed that the second part 116 cooperates with the first part 112. More specifically, the first anchoring module 110 includes a displacement device 122 for moving the second part 116 relative to the first part 112 along a first direction A. It can be observed that, when the first anchoring module is mounted to the frame, the first direction A is parallel to the longitudinal direction X of the frame, these two directions being substantially vertical.

In this example, the displacement device 122 includes an actuator 124 connected to the first part 112 and to the second part 116. The actuation of the actuator 124 has the effect of moving the second part 116 relative to the first part 112 in translation along the first direction A. In this example, the actuator 124 comprises a hydraulic cylinder 126. In order to allow supplying the hydraulic cylinder 126 with hydraulic fluid, the anchoring kit 100 further includes a hydraulic fitting 130 which is connected to the cylinder 126 and which is also configured to be connected to a hydraulic hose 13 of the frame 12.

Referring to FIGS. 1, 2, 3 and 4, it is understood that the fixing device 118 allows securing, in a removable manner, the second part 116 to the first small face 12*c* of the frame 12.

The fixing device also allows dismounting the anchoring kit when the latter is no longer needed. Referring to FIGS. 4 and 5, it can be observed that the anchoring device 114 includes a first and a second anchoring pad 140, 142 which are deployable along a second direction B transverse to the first direction A. It is also understood that the direction of deployment of the first anchoring pad 140 is opposite to the direction of deployment of the second anchoring pad 142. FIG. 5 illustrates the anchoring device in the anchored position, the first and second anchoring pads 140, 142 bearing against the opposite walls P1 and P2 of the trench T excavated in the soil S in order to immobilize the first part 112.

Referring to FIG. 5, it can be observed that the first part 112 further includes a body 144, and the anchoring device 114 includes first and second actuators 146, 148. In this example, hydraulic cylinders are respectively connected to the first and second anchoring pads 140, 142. The actuators 146, 148 are slidably mounted relative to the body 144 along a third direction C transverse to the first direction A. In this example, the second and third directions B, C are parallel. This floating mounting has the effect of anchoring the first part 112 in the soil without modifying the position of the body 144, which allows not modifying the position of the drilling module during anchoring. One advantage is not to deflect the drilling path during anchoring.

Referring again to FIGS. 2, 3 and 4, it can be observed that the first anchoring module 110 further includes a guide system 150 for guiding the displacement of the frame 12 in translation relative to the first part 112 along the first direction A.

The guide system 150, better visible in FIG. 4, includes a first portion 152 and a second portion 154 which is slidably mounted relative to the first portion. The second portion 154 includes fixing members 156 for fixing the second portion 154 to the frame 12. Furthermore, the first part 112 of the first anchoring module 110 includes the first portion 152 of the guide system 150. In this example, the second portion 154 includes a rail 158, while the first portion 152 includes a groove 160 in which the rail 158 engages, which allows defining a sliding connection between the frame 12 and the first part 112 of the first anchoring module 110.

It is also understood that the rail 158 is securely fixed to the frame thanks to the fixing members 156, for example bolts.

As understood from FIGS. 2 and 3, the anchoring kit 100 further includes a second anchoring module 110' which is here identical to the first anchoring module 110.

The second anchoring module 110' also includes a first part 112' provided with an anchoring device 114', and a second part 116' intended to be fixed to the frame 12. It further includes a fixing device 118' to the frame, as well as a displacement device 122'.

As illustrated in FIGS. 2 and 3, the anchoring kit 100 further includes a connecting device 170 for securing together the first and second anchoring modules 110, 110'. In this example, the connecting device 170 is arranged to secure together the first parts 112, 112' of the first and second anchoring modules 110, 110'. The connecting device here consists of bars 172, 174 forming a rigid element which connects the first parts to each other.

Thanks to FIGS. 2 and 3, it is understood that when the anchoring devices of the first parts of the first and second anchoring modules 110, 110' are actuated, said first parts are immobilized in the soil. In FIG. 2, the displacement devices are in the retracted position. The subsequent actuation of the displacement devices 122, 122' has the effect of deploying the hydraulic cylinders, which then exert a pull directed downwardly on the second parts of the first and second anchoring modules, and therefore on the frame and afterwards on the drilling module. As explained above, one advantage is to facilitate the drilling in the presence of hard ground.

In the example of FIGS. 2 to 4, the second part 116 of the first anchoring module is disposed between the first part 112 and the drilling module 16. Thanks to FIGS. 6 and 7, a second embodiment of the anchoring kit 200 according to the present invention will now be described.

The anchoring kit 200 is mounted on the drilling machine 10 illustrated in FIG. 1. Like the first embodiment, the anchoring kit 200 includes a first anchoring module 210 which comprises a first part 212 including an anchoring device 214 for immobilizing the first part 212 in the soil, as well as a second part 216 including a fixing device 218 for fixing the second part to the frame 12, the second part 216 cooperating with the first part 212.

The anchoring kit 200 also includes a displacement device 222 for moving the second part 216 relative to the first part 212 along the first direction A.

Figure 7:
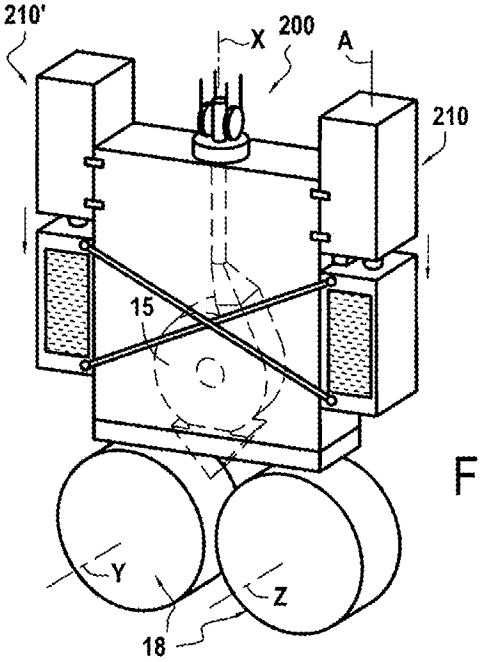
FIG. 7 illustrates the machine of FIG. 6, the displacement device being retracted to exert on the drilling module a force directed downwardly.
Figure 6:
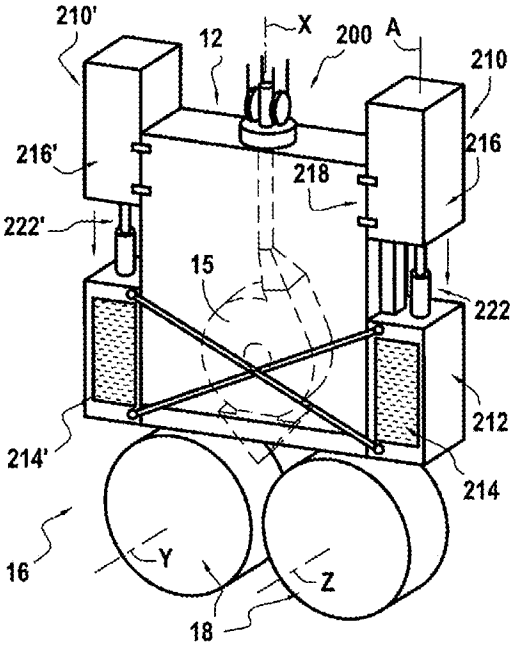
FIG. 6 illustrates the drilling machine of FIG. 1 equipped with an anchoring kit according to a second embodiment of the invention, the displacement device being deployed.

It is understood from FIGS. 6 and 7 that the anchoring kit 200 according to the second embodiment is very similar to the anchoring kit 100 according to the first embodiment which has been described above. Said anchoring kit 200 includes anchoring devices 214, 214', as well as displacement devices 222, 222' comprising hydraulic cylinders. The second embodiment of the anchoring kit 200 differs from the first embodiment in that the first part is disposed between the second part and the drilling module. In FIG. 6, the displacement devices 222, 222' are in the deployed position. When the anchoring devices 214, 214' are actuated, that is to say when the first part is immobilized in the soil, the actuation of the displacement devices 222, 222' has the effect of bringing the cylinders of the displacement devices 222, 222' in the retracted position, which exerts a pull directed downwardly on the second part 216, which therefore causes a pull on the frame 12 and therefore on the drilling module 16.

Figure 9:
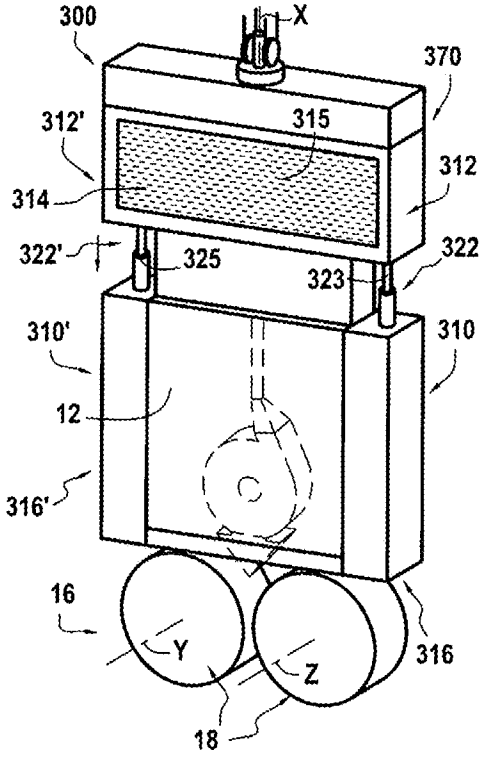
FIG. 9 illustrates the machine of FIG. 8, the displacement device being deployed.
Figure 8:
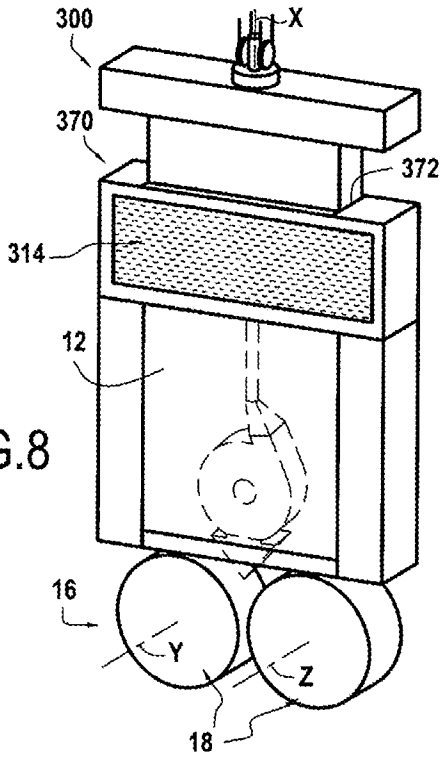
FIG. 8 illustrates the drilling machine of FIG. 1 equipped with an anchoring kit according to a third embodiment of the invention, the displacement device being in the retracted position.

Thanks to FIGS. 8 and 9, a third embodiment of the anchoring kit 300 according to the invention will now be described. Here again, the anchoring kit 300 is mounted on the drilling machine 10 illustrated in FIG. 1.

The third embodiment of the anchoring kit 300 differs from the first embodiment in that the connecting device 370 which links together the first parts 312, 312' of the first and second anchoring modules 310, 310' includes a passage 372 for guiding the displacement of the frame 12 along the longitudinal direction X. Seen otherwise, the first parts 312, 312' of the first and second anchoring modules 310, 310' form a single piece. In this example, this single part includes an anchoring device 314 provided with a pair of large anchoring pads 315 which extend along the width of the drilling machine. Also, in this example, the second part 316 of the first anchoring module 310 is also disposed between the first part 312 of the first anchoring module 310 and the drilling module 16.

This anchoring kit 300 includes a first actuator 323 disposed between the connecting device 370 and the second part 316 of the first 5 anchoring module 310 and a second actuator 325 disposed between the connecting device 370 and the second part 316' of the second anchoring module 310'.

When the anchoring device 314 is actuated, the first part is immobilized in the soil. Like the first embodiment, the first and second 10 actuators 323, 325 are in the retracted position, as illustrated in FIG. 8, and the actuation of the displacement device 322 has the effect of deploying the first and second actuators 323, 325, which generates a push directed downwardly on the frame 12 and on the drilling module 16.

The invention claimed is:

1. A removable anchoring kit for a drilling machine comprising a frame which carries a drilling module, the removable anchoring kit including at least a first anchoring module comprising:

a first part including an anchoring device for immobilizing the first part in soil, wherein the anchoring device is a structural unit distinct from the drilling machine that is configured to be selectively added to the drilling machine to apply additional force to the drilling module;

a second part including a removable fixing device for removably fixing the second part to the frame, the second part cooperating with the first part; and a displacement device for moving the second part relative to the first part along a first direction, wherein the displacement device of the first anchoring module includes an actuator connected to the first part and to the second part of the first anchoring module, and wherein the anchoring device includes a first and a second anchoring pad which are deployable along a second direction transverse to the first direction, the direction of deployment of the first anchoring pad being opposite to the direction of deployment of the second anchoring pad, wherein the actuator comprises a hydraulic cylinder, and wherein the removable anchoring kit further includes a removable hydraulic fitting connected to the hydraulic cylinder, the removable hydraulic fitting being configured to be removably connected to a hydraulic hose of the frame.

2. The removable anchoring kit according to claim 1, wherein the first part further includes a body, and the anchoring device includes at least one actuator connected to the first and second anchoring pads, the at least one actuator being slidably mounted relative to the body along a third direction transverse to the first direction.

3. The removable anchoring kit according to claim 1, wherein the first anchoring module further includes a guide system for guiding the displacement of the frame relative to the first part.

4. The removeable anchoring kit according to claim 3, wherein the guide system includes a first portion and a second portion slidably mounted relative to the first portion, wherein the second portion includes members for fixing the second portion to the frame, and wherein the first portion is fixed to the anchoring device.

5. The removable anchoring kit according to claim 1, further including a second anchoring module.

6. The removeable anchoring kit according to claim 5, further including a connecting device for securing together the first and second anchoring modules.

7. The removeable anchoring kit according to claim 6, wherein the connecting device includes a passage for guiding displacement of the frame, wherein the displacement device includes a first actuator disposed between the connecting device and the second part of the first anchoring module and a second actuator disposed between the connecting device and the second part of the second anchoring module.

8. A drilling machine, comprising:

a frame extending along a longitudinal direction and having a lower part carrying a drilling module including at least a first anchoring module, the first anchoring module comprising:

a first part including an anchoring device for immobilizing the first part in the soil;

a second part being fixed to the frame; and a displacement device for moving the second part relative to the first part along a first direction, the displacement device comprising at least an actuator connected to the first part and to the second part of the first anchoring module;

wherein the anchoring device includes a first and a second anchoring pad which are deployable along a second direction transverse to the first direction, the direction of deployment of the first anchoring pad being opposite to the direction of deployment of the second anchoring pad, wherein the first part is between the second part and the drilling module, and wherein the actuator is configured to exert a downward pull on the second part causing the second part to move towards the first part and thereby cause the frame and on the drilling module to move downward relative to the first part.

9. The drilling machine according to claim 8, wherein the lower part of the frame is provided with a pump, the drilling module being provided with cutting drums rotating about axes perpendicular to the longitudinal direction, in which the length of the drilling machine is less than 7 meters.

10. The drilling machine according to claim 8, wherein the first part further includes a body, and the anchoring device includes at least one actuator connected to the first and second anchoring pads, the at least one actuator being slidably mounted relative to the body along a third direction transverse to the first direction.

11. The drilling machine according to claim 8, wherein the first anchoring module further includes a guide system for guiding the displacement of the frame relative to the first part.

12. The drilling machine according to claim 11, wherein the guide system includes a first portion and a second portion slidably mounted relative to the first portion, wherein the second portion includes members for fixing the second portion to the frame, and wherein the first portion is fixed to the anchoring device.

13. The drilling machine according to claim 8, further including a second anchoring module.

14. The drilling machine according to claim 13, further including a connecting device for securing together the first and second anchoring modules.

15. The drilling machine according to claim 8, wherein the actuator comprises a hydraulic cylinder and wherein the displacement device is arranged so that the actuation of the displacement device brings the hydraulic cylinder in retracted position.

* * * * *